US005463541A

United States Patent [19]

Greene

[11] Patent Number: 5,463,541

[45] Date of Patent: Oct. 31, 1995

[54] OMNI-DIRECTION VIBRATION DAMPENING LAMPHOLDER ASSEMBLY

[76] Inventor: Kenneth L. Greene, 20 Cornelia La., Lake Grove, N.Y. 11755

[21] Appl. No.: 943,033

[22] Filed: Sep. 10, 1992

[51] Int. Cl.[6] ..... F21V 15/04

[52] U.S. Cl. ..... 362/369; 362/390; 439/382

[58] Field of Search ..... 439/382, 385, 439/350; 362/226, 274, 288, 306, 369, 390; 313/50, 269

[56] References Cited

U.S. PATENT DOCUMENTS

| | | | |
|---|---|---|---|
| 2,212,728 | 8/1940 | Blood | 439/382 |
| 2,234,954 | 3/1941 | Bergman | 362/274 |
| 2,445,072 | 7/1948 | Lee | 362/306 |
| 2,529,279 | 11/1950 | Breisch | 439/382 |
| 2,686,868 | 8/1954 | Diedring | 439/382 |
| 2,905,742 | 9/1959 | Woods | 439/382 |
| 2,966,579 | 12/1960 | Malec | 362/369 |
| 3,115,307 | 12/1963 | Dickson | 439/382 |
| 3,127,117 | 3/1964 | Mappes | 362/288 |
| 3,671,923 | 6/1972 | Rieth | 439/385 |
| 3,676,834 | 7/1972 | Kaldor et al. | 439/350 |
| 3,980,878 | 9/1976 | Crompton | 362/390 |
| 4,176,391 | 11/1979 | Kulik et al. | 362/369 |
| 4,282,566 | 8/1981 | Newman | 362/369 |
| 4,422,136 | 12/1983 | Newman et al. | 362/390 |
| 4,437,145 | 3/1984 | Roller et al. | 362/390 |
| 4,591,961 | 5/1986 | Myles et al. | 362/369 |
| 4,740,876 | 4/1988 | Roller | 362/306 |
| 4,922,395 | 5/1990 | Roney | 362/390 |

FOREIGN PATENT DOCUMENTS

| | | | |
|---|---|---|---|
| 3217254 | 12/1982 | Germany | 439/611 |

*Primary Examiner*—Ira S. Lazarus
*Assistant Examiner*—Alan Cariaso

[57] ABSTRACT

An omni-direction vibration dampening lampholder assembly includes a lampholder assembly housing member having an open top end and an open bottom end, a resilient body freely disposed in the housing member, and a lampholder encased in an upper portion of the housing member. In addition to absorption of vibratory forces, resilient body dampens vibrations by lateral and longitudinal displacement thereof through the open top end of housing member and the open bottom end of housing member.

5 Claims, 2 Drawing Sheets

OMNI-DIRECTION VIBRATION DAMPENING LAMPHOLDER ASSEMBLY

BACKGROUND OF THE INVENTION

The present invention generally relates to lampholders. More particularly, this invention relates to a vibration dampening lampholder for high intensity lighting structures.

Lighting structures experience various forms of vibration. This is particularly true for lighting structures located adjacent to bridges, roadways, railways and the like. Lampbulbs in such lighting structures are often damaged by the vibratory effects of passing vehicles, as well as wind loads and structure harmonics, which are usually low frequency, high amplitude vibrations. Lamp bulbs generally experience two types of damage from vibratory loads: shattering of the lamp envelope, and shattering of the lamp arc tube and other internal components. The various means known in the prior art for dampening the effects of vibration in lighting structures generally only succeed in reducing the shattering of the lamp envelope and then only to a limited extent. These prior art vibration dampening means are generally totally ineffective in preventing the shattering of internal components and may in fact facilitate damaging of internal components by directly transmitting vibratory loads from the lamp envelope to the brittle, spot welds utilized to fix the internal components of a lamp. Furthermore, lighting structures and the lamps disposed therein are subjected to vibratory forces from a variety of directions. The prior art vibration dampening means generally do not provide for omni-directional dampening of lateral, longitudinal and angular vibratory forces and therefore are further limited in their effectiveness. A still further limitation of the prior art dampening means for lighting structures is that they are generally unsuitable for use in the high temperature environs of roadway lighting structures which utilize high intensity lamps such as sodium, metal halide and mercury lamps. Lamp temperatures in such high intensity lighting structures may exceed 400° F.

To dampen vibrations, various lampholders in the prior art include stiff metal supports and springs which engage the lamp envelope. A further exemplary prior art lampholder is illustrated in U.S. Pat. No. 3,908,878 to Crompton wherein there is shown a vehicle signal lamp that includes a bifurcated resilient member which telescopically receives a lamp socket for dampening of vibrations and mild shocks. In U.S. Pat. No. 4,176,391 to Kulik et al. a shock isolating lamp assembly for a vehicle lamp is disclosed that includes a resilient member which receives a lamp socket, the resilient member being formed having paired laterally-extending arms connected to respective mounting bars. U.S. Pat. No. 4,282,566 to Newman discloses a shock mounting bracket for a vehicle lamp bulb comprising a serpentine strip having a centrally located bulb-receiving socket which engages the base of the bulb. A conductive track circuit for a vehicle lamp bulb to protect the bulb from shock loads and vibrations is illustrated in U.S. Pat. No. 4,922,395 to Roney. The above-noted prior art references all disclose vibration dampening means limited by their engagement of a lamp socket or the base of a lamp bulb to reduce vibratory effects. These prior art references also do not disclose or suggest vibration dampening means for high intensity structures.

U.S. Pat. No. 3,671,923 to Rieth discloses a lamp socket that includes integrally-formed cantilever extension walls which support the envelope of a low intensity, wedge-type lamp bulb. In U.S. Pat. No. 3,676,834 to Kaldor et al. a vehicle lamp assembly is disclosed that includes an upwardly-extending resilient portion which grips the bulb envelope of a wedge-type bulb above its base for dampening of road shocks.

While the various prior art lamp vibration dampening means reduce vibratory effects to various degrees, certain limitations therein are overcome by the vibration dampening lampholder assembly of the present invention.

SUMMARY OF THE INVENTION

The lampholder assembly of the present invention generally comprises a lampholder assembly housing member having an open top end and a partially open bottom end, a resilient body movably disposed in the housing member, and a lampholder fixedly disposed in an upper portion of the resilient body having the side wall and the bottom wall of the lampholder completely encased in the resilient body. The lower portion of the resilient body includes a central opening disposed below the lampholder which extends to the partially open bottom end of the housing member. The central opening in the resilient body permits the resilient body to selectively deform relative to said housing member and move through the respective open top end and open bottom end thereof to dampen vibrations and shocks to a lamp disposed in the lampholder. The lamp and lampholder are thereby maintained in consistent relative displacement during vibratory loading which minimizes damage to the lamp. Resilient body is preferably formed from 40-durometer, high elongation room temperature vulcanizing (RTV) silicone rubber or a suitable elastomer for use of the lampholder assembly in high intensity lighting structures.

An object of the present invention is to provide a lampholder assembly which dampens vibratory loads on a lamp disposed in a lighting structure.

Another object of this invention is to provide a lampholder assembly which dampens vibrations in all directions.

A further object of the present invention is to provide a lampholder assembly which prevents vibratory damage to both the lamp envelope and the internal components of the lamp.

A still further object of this invention is to provide a lampholder assembly useful in the high temperature environs of high intensity lighting structures.

It is also an object of this invention to provide a lampholder assembly that retains a lamp socket and the lamp disposed therein in consistent relative displacement during vibratory loading.

Another object of this invention is to provide a lampholder that effectively extends lamp bulb life.

It is also an object of the present invention to provide a lampholder assembly that includes a resilient body that dampens vibrations by both absorption of the load and deformation of the resilient body.

These and other objects and advantages of the omni-direction vibration dampening lampholder assembly of the present invention will be apparent to those skilled in the art from the following description of preferred embodiments, claims and appended drawings.

DESCRIPTION OF THE PREFERRED EMBODIMENTS

The present invention is a lampholder assembly for a lighting structure that includes omni-direction vibration dampening means. The lampholder assembly of the present invention is particularly useful for lighting structures utilizing high intensity lamps.

Figure 1:
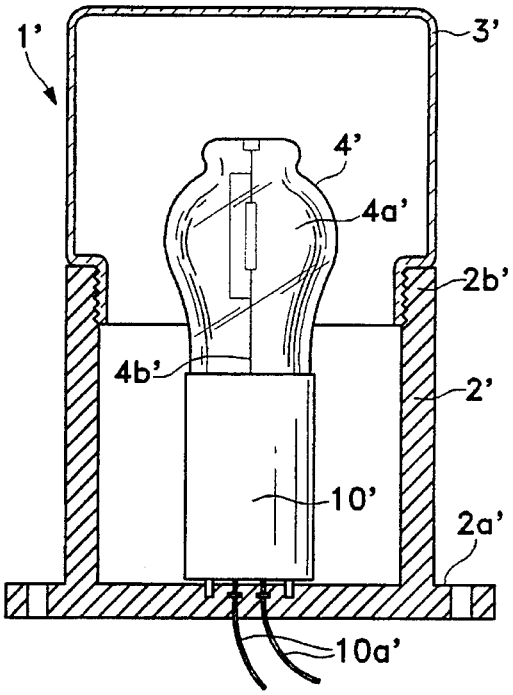
FIG. 1 (PRIOR ART)
FIG. 1 is a vertical cross-sectional view of a lighting structure that includes a prior art lampholder.

FIG. 1 illustrates in a vertical cross-sectional view a lighting structure 1' including a lampholder 10' as known in the prior art. Lighting structure 1' generally comprises a structure housing member 2' selectively attachable at the base 2*a*' thereof to a pole, wall, or the like; a housing member globe 3' selectively attachable to the head 2*b*' of the structure housing member 2'; a lampholder 10' fixedly attachable to an inside portion of the base 2*a*' of the structure housing member 2' and including electrical lead wires 10*a*' extending therefrom; and a lamp 4' selectively attachable to the lampholder 10'. As previously mentioned in brief, lamp 4' includes a lamp envelope 4*a*' and lamp arc tube 4*b*'. Damage to both the lamp envelope 4*a*' and the lamp arc tube 4*b*' from vibratory loads has been observed, separately and in combination, in the prior art lighting structure 1'. Lead wire connectors 10*b*' for electrical attachment of lead wires 10*a*' to lampholder 10' have also been damaged in the prior art by vibrations of the lighting structure 1'.

Figure 2:
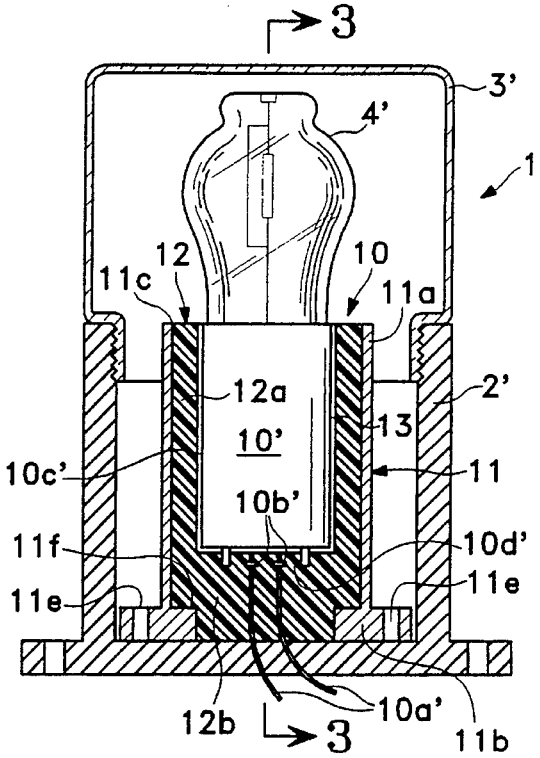
FIG. 2 is a vertical cross-sectional view similar to that shown in FIG. 1 illustrating a lighting structure that includes a first preferred embodiment of the lampholder assembly of the present invention.

FIG. 2 illustrates in a vertical cross-sectional view similar to that of FIG. 1 a lighting structure 1 including a first preferred embodiment of a lampholder assembly 10 constructed in accordance with the teachings of the present disclosure. Lighting structure 1 includes a structure housing member 2', housing member globe 3' and lamp 4' as known in the prior art. In lieu of the prior art lampholder 10' there is provided the novel, first lampholder assembly 10 of the present invention.

Figure 3:
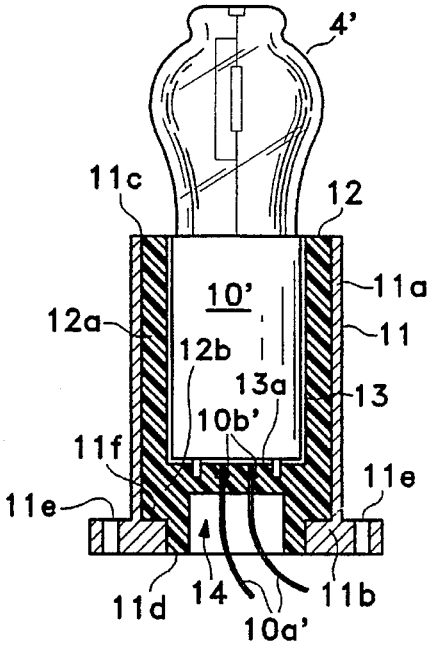
FIG. 3 is a vertical cross-sectional view of the first preferred embodiment of the lampholder assembly taken along line 3—3 of FIG. 2.
Figure 4:
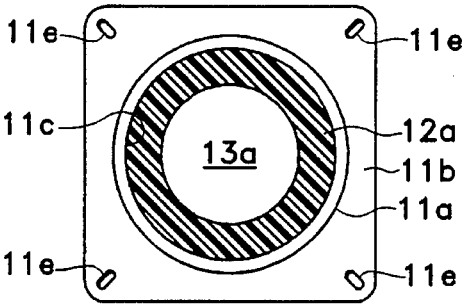
FIG. 4 is a top plan view of the first lampholder assembly having the lampholder thereof removed.
Figure 5:
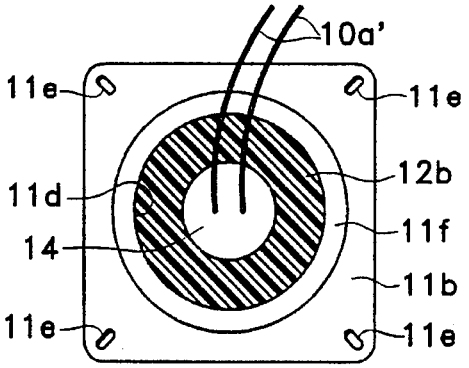
FIG. 5 is a bottom plan view of the first lampholder assembly.

First lampholder assembly 10 generally comprises a lampholder assembly housing member 11, a resilient body 12 movably disposed in the interior of housing support member 11 and a lampholder 10, constructed as known in the prior art, fixedly disposed in a lampholder cavity 13 formed in a resilient body upper portion 12*a*. Lampholder assembly housing member 11, preferably formed from cast or extruded aluminum, includes a hollow, housing member upper portion 11*a*, preferably cylindrical in shape, and a flat, preferably square, housing member base plate portion 11*b* (FIGS. 4 and 5). Base plate portion 11*b* is integrally formed with the bottom end of the housing member upper portion 11*a*. The top end 11*c* of hollow, housing member upper portion 11*a* is open and a base plate opening 11*d* (FIG. 3) extends through a central portion of base plate portion 11*b*. Base plate portion 11*b* extends laterally from the outer wall of the housing member upper portion 11*a* and includes screw-mounting openings 11*e* formed in the respective corners of the base plate portion 11*b* for attachment of the first lampholder assembly 10 to the structure housing member 2'.

Resilient body 12 is preferably formed from silicon rubber or an elastomer. To meet the functional requirements of the present invention resilient body 12 must be a rubber band-like material having high elongation and elasticity characteristics so that it is capable of deforming relative to lampholder housing member 11. Resilient body 12 must also be capable of resisting degradation from the high temperatures of high intensity lamps. Suitable material for resilient body 12 is manufactured by Dow Corning Corporation. Dow Corning's SILASTIC E RTV brand silicone rubber is designed for use as a flexible, moldmaking and generally potting and encapsulating material. It is a high-strength, tear-resistant rubber that offers easy release, high elongation and minimum shrinkage. SILASTIC E RTV brand silicone rubber is also serviceable over a wide temperature range. 40-durometer silicone rubber is preferred for resilient body 12. Dow Corning's SYLGARD brand elastomers are solventless silicone materials designed for potting and encapsulating electronic components. They form resilient embedments which protect against moisture, dirt, shock, vibration and other harsh environmental factors. SYLGARD brand elastomers will not normally bond to clean, non-porous surfaces such as metal or glass and are resistant to high temperatures.

As previously mentioned, resilient body 12 includes a lampholder cavity 13 formed in resilient body upper portion 12*a*. Cavity 13 extends to the top end of resilient body 12 for receipt of a lampholder 10'. The side wall 10*c*' and bottom wall 10*d*' of lampholder 10' are fully encased by resilient body upper portion 12*a*. Resilient body 12 conforms to the interior surface of housing member 11 and further includes a deformation opening 14, substantially comprising a circular slot, that extends to the bottom end of resilient body lower portion 12*b*. Deformation opening 14 facilitates vibration dampening as hereinafter described in greater detail. Resilient body lower portion 12*b* rests in bearing engagement on a resilient body seat 11*f* formed in the base plate portion 11*b* adjacent to the base plate opening 11*d* formed therein. The electrical lead wires 10*a*' of lampholder 10' extend through he bottom wall 13*a* of cavity 13 and through the deformation opening 14 formed in resilient body lower portion 12*b*. Lead wire connectors 10*b*' are preferably embedded in resilient body lower portion 12*b*.

Lampholder 10' is preferably a porcelain body, screw-in mogul lampholder suitable for street and roadway lamps. However, the present invention is not limited by the type of lampholder utilized and may be adapted for use with any of a variety of lampholders.

Figure 6:
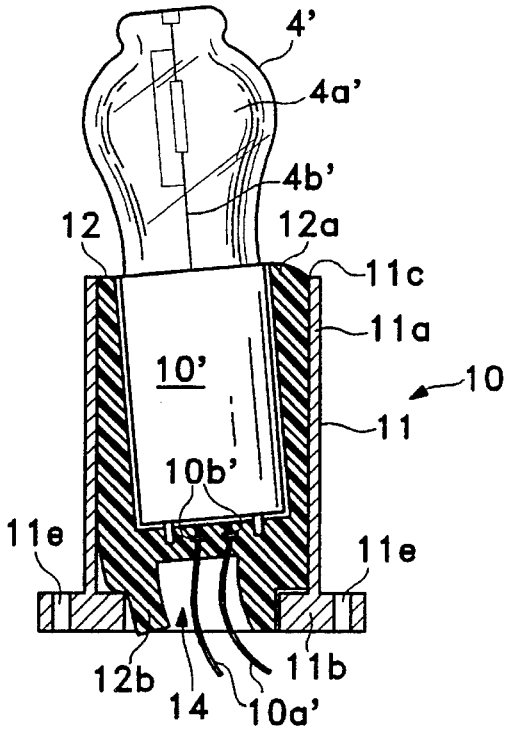
FIG. 6 is a vertical cross-sectional view of first lampholder assembly illustrating deformation of the resilient body under vibratory loading.

FIG. 6 illustrates the deformation of resilient body 12 for vibration dampening in the first lampholder assembly 10 of the present invention. In the prior art a lampholder 10' is generally retained in a fixed position and vibration dampening is accomplished by resilient material, metal supports, springs etc. absorbing the vibratory forces. As previously mentioned, such constructions contribute to the breaking of the lamp envelope 4*a*' and the lamp arc tube 4*b*'. When the vibration absorption capacity of the prior art dampening means is exceeded, the vibratory force is transferred to the lamp 4'.

In the present invention the resilient body 12 is free to deform relative to lampholder assembly housing member 11 to maintain lamp 4' and lampholder 10' in consistent relative displacement. Therefore, when the vibration absorption capacity of resilient body 12 is exceeded, the first lampholder assembly 10 of the present invention further provides vibration dampening by displacement of resilient body 12 relative to lampholder assembly housing member 11. The open top end 11*c* of lampholder assembly housing member 11, in conjunction with the deformation opening 14 formed in the resilient body lower portion 12*b*, permits lateral and longitudinal displacement of resilient body 12. Referring to FIG. 6 it can be seen that when first lampholder assembly 10 is subjected to a vibratory force the resilient body lower portion 12*b* can move laterally through the deformation opening 14 and longitudinally through the base plate opening 11*d* of lampholder assembly housing member 11. Concurrently the resilient body upper portion 12*a* is free to move longitudinally through the open top end 11*c* of lampholder assembly housing member 11. It should be understood that a portion of the vibratory force is absorbed by resilient body 12 as known in the art. However, a most significant improvement provided by the first lampholder assembly 10 of the present invention is that the residual vibratory forces that in prior art structures are transferred to lampholder 10' and lamp 4' are dampened by the movement of resilient body 12 in lampholder housing member 11. Thus lampholder 10' and lamp 4' move together in all directions, first lampholder assembly 10 thereby providing omni-direction vibration dampening.

Figure 7:
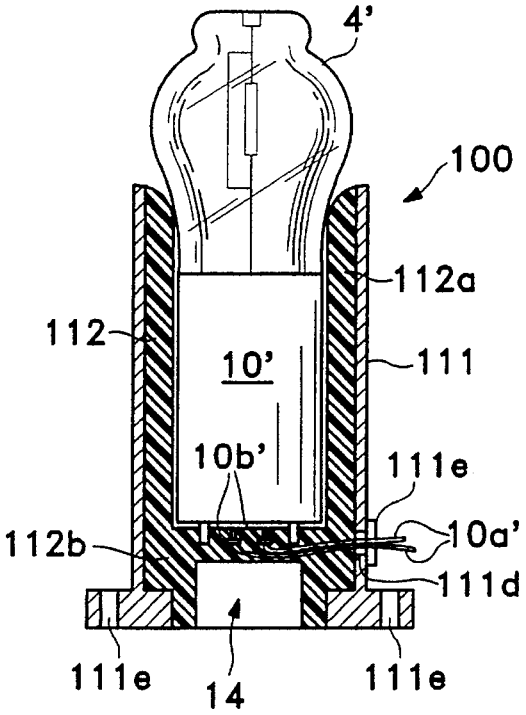
FIG. 7 is a vertical cross-sectional view of a second preferred embodiment of a lampholder assembly constructed in accordance with the teachings of the present invention.

Referring now to FIG. 7 a second preferred embodiment of a lampholder assembly 100 constructed in accordance with the teachings of the present invention is illustrated. Second lampholder assembly 100 includes a second lampholder assembly housing member 111 and a second resilient body 112. Second resilient body 112 includes an upper portion 112*a* that encases lampholder 10*a* and a lower portion of lamp 4'. The encasement of the lower portion of lamp 4' by second resilient body 112 further facilitates the maintenance of consistent relative displacement of lampholder 10' and lamp 4' as heretofore described. Second lampholder assembly 100 further includes a housing member side wall opening 111*d* covered by a grommet 111*e*. Electrical lead wires 10*a*' extend through second resilient body lower portion 112*b* and through side wall opening 111*d*.

Figure 8:
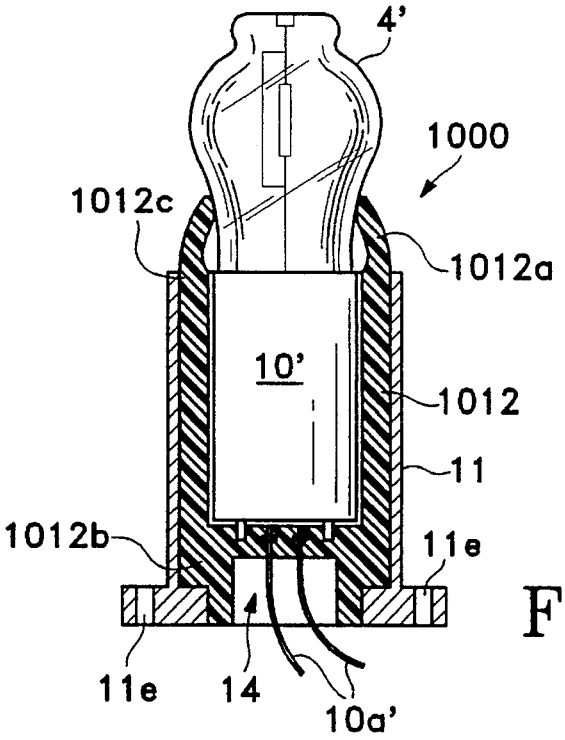
FIG. 8 is a vertical cross-sectional view of a third preferred embodiment of a lampholder assembly constructed in accordance with the teachings of the present invention.

A third preferred embodiment of lampholder assembly 1000 is illustrated in FIG. 8. Third lampholder assembly 1000 is formed as heretofore described for first lampholder assembly 1 with the exception that third resilient body 1012 includes a lamp engaging portion 1012*a*, substantially comprising an annular extension integrally formed at the top end 1012c of third resilient body 1012 and extending beyond the top end 11*a* of lampholder assembly housing member 11. Lamp engaging portion 1012*a* engages the lower portion of lamp 4'. Again, the lamp engaging portion 1012*a* of third resilient body 1012 facilitates the maintenance of consistent relative displacement of lampholder 10' and lamp 4' for additional vibration dampening.

Various changes, modifications and additions may be made to the preferred embodiments of the lampholder assembly of the present invention without departing form its spirit and scope. Such changes, modifications and additions within a fair reading of the following claims are intended as part of the present disclosure.

Therefore, in view of the foregoing, I claim:

1. An omni-direction vibration dampening lampholder assembly for a lighting structure, said lampholder assembly comprising a housing member selectively attachable to a lighting structure, said housing member comprising a hollow upper portion and a base plate portion, a top end and a bottom end of said housing member being open;

a resilient body disposed in said housing member, an upper portion of said resilient body being co-extensive with the upper portion of said housing member and having a lampholder cavity formed therein, a lower portion of said resilient body having a deformation opening formed therein and disposed adjacent to the open bottom end of said housing member; and a lampholder disposed in the cavity of said resilient body, side walls and a bottom wall of said lampholder being fully encased within said resilient body, said resilient body being selectively displaceable from said housing member for vibration dampening by displacement of the lower portion of said resilient body through the open bottom end of said housing member and by displacement of the upper portion of said resilient body through the open top end of said housing member thereby maintaining said lampholder and a lamp disposed therein in consistent relative displacement.

2. A lampholder assembly as in claim 1 wherein said upper portion of said resilient body and said upper portion of said housing member extend upwardly to a top end of said lampholder.

3. A lampholder assembly as in claim 1 wherein said upper portion of said resilient body and said upper portion of said housing member extend upwardly to a lower portion of a lamp disposed in said lampholder, said upper portion of said resilient body engaging the lower portion of said lamp.

4. A lampholder assembly as in claim 2 further including a lamp engaging resilient body portion integrally formed with and extending upwardly from said resilient body, said lamp engaging resilient body portion engaging a lower portion of a lamp disposed in said lampholder.

5. An omni-direction vibration dampening lampholder assembly for a lighting structure, said lampholder assembly comprising a housing member selectively attachable to a lighting structure, said housing member comprising a hollow, cylindrical upper portion, a top end of said upper portion being open, and a base plate portion integrally formed with a bottom end of said upper portion, said base plate portion including a base plate opening communicating with an interior portion of said upper portion, said base plate portion including at least one attachment opening for attachment of said housing member to said lighting structure, said base plate portion further including a seat for receipt of a resilient body;

a resilient body disposed in said housing member and retained therein by bearing engagement with said seat, said resilient body having high elongation and elasticity characteristics, an upper portion of said resilient body being coextensive with the upper portion of said housing member, said upper portion of the resilient body having a resilient body cavity formed therein and extending to a top end of the upper portion of said resilient body, a lower portion of said resilient body extending to the bottom end of said base plate portion, said lower portion of the resilient body having a deformation opening formed therein and disposed adjacent to the base plate opening of said base plate portion for selective lateral and longitudinal displacement of the lower portion of said resilient body through said deformation opening and said base plate opening in response to vibratory loads, said resilient body further including a resilient body extension disposed on a top end of the upper portion of resilient body; and a lampholder having side walls and bottom wall thereof fully encased in the resilient body cavity.

* * * * *